US005806976A

United States Patent [19]

Roque

[11] Patent Number: 5,806,976

[45] Date of Patent: Sep. 15, 1998

[54] HIGH-SPEED FLUID MIXING DEVICE

[75] Inventor: Claude Roque, Chatou, France

[73] Assignee: Institut Francais du Petrole, Rueil-Malmaison, France

[21] Appl. No.: 750,622

[22] PCT Filed: Apr. 12, 1996

[86] PCT No.: PCT/FR96/00557

§ 371 Date: Dec. 13, 1996

§ 102(e) Date: Dec. 13, 1996

[87] PCT Pub. No.: WO96/32185

PCT Pub. Date: Oct. 17, 1996

[30] Foreign Application Priority Data

Apr. 13, 1995 [FR] France ..... 95 04575

[51] Int. Cl.[6] ..... B01F 5/06

[52] U.S. Cl. ..... 366/338; 366/165.1; 366/165.2

[58] Field of Search ..... 366/150.1, 154.1, 366/162.4, 163.1, 164.2, 165.1, 165.2, 165.4, 165.5, 167.1, 167.2, 174.1, 176.1, 178.1, 178.3, 181.8, 336, 338, 344, 262, 318, 263, 182.2, 339

[56] References Cited

U.S. PATENT DOCUMENTS

| | | | |
|---|---|---|---|
| 835,619 | 11/1906 | Isaacs et al. | 366/165.4 |
| 1,743,738 | 1/1930 | Travis | 366/167.1 |
| 2,306,962 | 12/1942 | Kropp | 366/167.1 |
| 2,784,948 | 3/1957 | Pahl et al. | 366/174.1 |
| 3,251,550 | 5/1966 | Lippert et al. | 366/178.3 |
| 3,682,447 | 8/1972 | Zucker et al. | 366/178.1 |
| 3,697,051 | 10/1972 | Lachman et al. | 366/178.3 |
| 4,108,732 | 8/1978 | Nuttall, Jr. | 366/165.1 |
| 4,197,092 | 4/1980 | Bretz | 366/169.1 |
| 4,270,576 | 6/1981 | Takeda et al. | 366/165.2 |

FOREIGN PATENT DOCUMENTS

| | | | |
|---|---|---|---|
| 216782 | 1/1908 | Germany | 366/318 |

*Primary Examiner*—Tony G. Soohoo
*Attorney, Agent, or Firm*—Antonelli, Terry, Stout & Kraus, LLP

[57] ABSTRACT

A device for uniformly and virtually instantaneously mixing at least two fluids, comprising at least two feed channels each of which is shaped and sized so that it produces flat fluid streams, whereby a uniform mixture may be achieved virtually instantaneously in a limited area.

20 Claims, 2 Drawing Sheets

HIGH-SPEED FLUID MIXING DEVICE

FIELD OF THE INVENTION

The present invention relates to a device for mixing at least a first and a second fluid virtually instantaneously. It notably allows a uniform mixture to be obtained.

The present invention advantageously applies for mixing quickly and virtually instantaneously several fluids likely to react with each other.

Reactions likely to occur between various fluids when they mix can generate corrosive or incrusting actions on an element which they are in contact with, for example a wall of a pipe in which they circulate.

The term "action" is defined in the text hereafter as the power or the ability of a mixture to cause depositions and/or to corrode an element, for example an installation in which the mixture circulates.

It is preferable and even, in some cases, essential to have a mixing area as small-sized as possible and a mixing time as short as possible in order to confine the reactions likely to occur between the fluids, such as possible physico-chemical reactions.

An advantageous application of the present device consists in using it as a laboratory apparatus associated, for example, with an apparatus for studying the evolution kinetics of a mixture of incompatible fluids.

The invention can notably be applied within the scope of petroleum production where it is usual to find a formation water associated with oil, or one or several injection waters used for enhanced recovery of the petroleum effluent. Contact between these two waters can cause physico-chemical reactions, such as nucleation, germination and growth leading to the formation of crystals or deposits that may eventually block the pipes in which the mixtures circulate. It is therefore important to study the kinetics of formation and evolution of such crystals in order to know and to foresee the resulting problems that often require costly production facility repairs and shutdowns.

In order not to be affected by interaction problems before the fluids are fed into the suitable analysis device, the latter must comprise a fluid mixing device or mixer allowing a mixture to be obtained virtually instantaneously. The time when physico-chemical reactions can start between different fluids can thus be precisely determined. Possible errors due to physico-chemical phenomena occurring prior to the entry of the fluids or of the mixture of fluids in the analysis device can thus be avoided.

In the following description, the expression "incompatible fluids or waters" relates to fluids whose mixing or bringing together leads to physical or chemical reactions such as nucleation, germination and growth of crystals.

BACKGROUND OF THE INVENTION

There are well-known devices for mixing various fluids, comprising a first tube in which a first fluid circulates and a second tube surrounding the first tube, concentric with respect to the latter, in which a second fluid circulates. Turbulence phenomena generated by the circulating motion of the fluids can lead to the formation of seeds that move up along the tubes and become incrusted for example in the inner wall of the outer tube. The deposits produced on the walls eventually block the mixer.

There are also well-known mixers referred to as "countercurrent mixers" working according to the principle as follows: the fluids to be mixed circulate in opposite directions and meet in an area referred to as mixing area. However, at the level of the mixing area, deposits may form on the walls of the mixing area and block the pipes in which the fluids circulate. Such mixers are not suitable for mixing incompatible fluids.

SUMMARY OF THE INVENTION

The device according to the invention allows the above-mentioned drawbacks to be overcome and notably to prevent and/or to minimize the formation of deposits by performing a fast and virtually instantaneous mixing of the fluids. Furthermore, it allows a uniform mixture of the fluids to be achieved by mixing them in a limited area.

Instantaneous and fast mixing of the two waters allows to know the precise time of the formation of the mixture and thus not to be affected by chemical, physical or physico-chemical reactions that might occur between the fluids before the measuring cell and produce erroneous or inaccurate results.

Such a device or mixer is particularly well suited to be positioned at the inlet of a cell for studying the deposit formation kinetics or corrosion problems resulting from the mixing of two incompatible waters.

The device for mixing at least a first and a second incompatible fluid comprises an inner piece including at least a first feed channel for delivering said first fluid, this first channel communicating with a window located in the lower part of the inner piece, this window having a section of flow S1 so selected that the first fluid flows out of the window in the form of a first flat fluid stream, the inner piece also comprises a groove situated on the outer wall thereof, this groove having a depth p and a length lg, an outer casing surrounds the inner piece, the outer casing being provided with at least one inlet port for delivering the second fluid and the outer casing being so situated in relation to the inner piece that the inner wall of the outer casing delimits, with the groove, a lateral circulation channel generating a second flat fluid stream, the two fluid streams meeting in an area allowing the mixture to be confined, delimited by the section of flow S1, the circulation channel and the inner wall of the outer casing so as to form a virtually instantaneous and uniform mixture.

Advantageously, in order to optimize the mixing operation, the direction of flow of the first flat fluid stream forms an angle $\alpha$ with the direction of flow of the second flat fluid stream, ranging between 60° and 90°, and preferably substantially equal to 90°.

The section of flow S1 being defined by a length L and a height h, the ratio L/h is preferably selected at least above 10.

In order to achieve a virtually instantaneous and uniform mixture, the velocities of the streams of said first fluid and second fluid preferably range between 0.1 and 5 m/sec.

According to an embodiment of the invention, the first channel can be situated substantially in the centre of the inner piece, and the inner piece can comprise, at the level of the lower part thereof, an area located between the lower end of the central channel and the window, the shape of the area being so selected that the pressure of the first fluid stream is distributed substantially uniformly over the section of flow S1 and the velocity thereof is substantially uniform over section S1.

The lateral channel can have a helical or a spiral shape so as to communicate a helical motion to the second fluid, notably allowing the first fluid to be carried along.

Advantageously, the outer piece can comprise an extension of suitable shape in order to maintain the helical or spiral motion of the mixture of fluids leaving the mixing area.

The mixer according to the present invention is particularly suitable at the inlet of a device intended for controlling the deposit formation kinetics for a mixture of two incompatible fluids.

It notably allows to generate an emulsion from immiscible fluids.

Thus, one of the significant original features of the device consists in generating flat fluid streams and in mixing these flat fluid streams thereafter with a sufficiently high velocity in order to obtain a virtually instantaneous and uniform mixture.

The layout of the circulation channels of the two fluids to be mixed is selected in order to obtain flat fluid streams whose directions form an angle allowing to achieve a virtually instantaneous mixture and to optimize the mixture. The directions of these fluid streams are preferably substantially orthogonal.

The second fluid flowing in the form of a helical flat stream carries along, after meeting it, the flat stream of the first fluid in its helical motion during which a vortex effect is created, allowing to concentrate the mixture of fluids likely to generate deposits towards the centre of the spiral and thus, by acceleration of the fluid and of the crystals in the process of formation, to minimize nucleation phenomena leading to incrustation on the outer elements in the neighbourhood of the mixing chamber.

BRIEF DESCRIPTION OF THE DRAWINGS

Other features of the invention will be clear from reading the description hereafter, given by way of non limitative examples, with reference to the accompanying drawings in which.

DESCRIPTION OF THE PREFERRED EMBODIMENTS

The description given hereafter by way of non limitative examples relates to a device suited for achieving a uniform mixture of at least two incompatible fluids quickly and virtually instantaneously. For simplicity reasons, the device is referred to hereafter as mixer.

Positioned for example at the inlet of a cell intended for the study of the deposit formation kinetics or the appearance of corrosion phenomena, such a mixer notably allows to determine precisely the time when mixing takes place and therefore the time when interactions between incompatible fluids can start.

Figure 1:
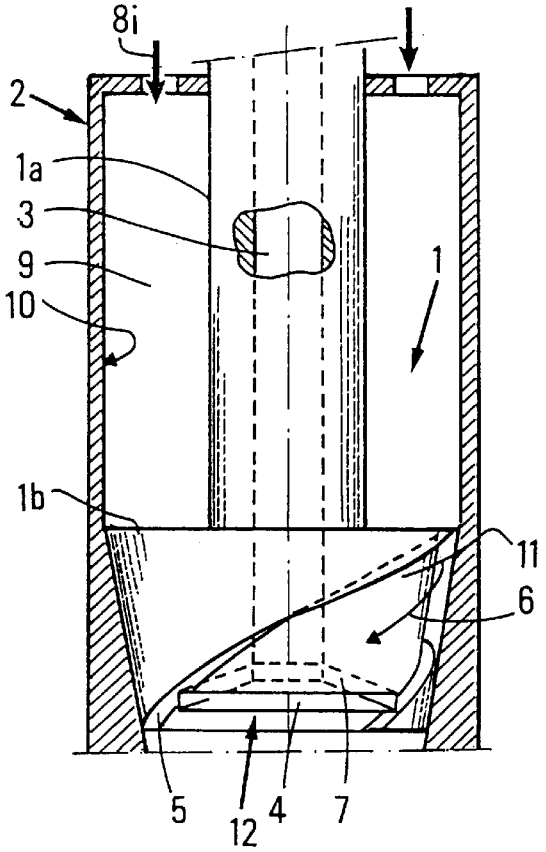
FIG. 1 is an overall view of the mixing device according to the invention.

The mixer of FIG. 1 comprises, for example, an inner piece 1 situated in an outer casing or chamber 2. Inner piece 1 can be made up of a first part 1*a,* substantially cylindrical, comprising a first circulation channel 3 for the first fluid and extended by a second part 1*b,* preferably conical or truncated-cone-shaped, comprising a second circulation channel 6 for the second fluid, described in detail hereafter.

The first channel 3 is preferably located along the central axis A of the part of inner piece 1.

The second part 1*b* is preferably conical or truncated-cone-shaped, and it opens out from the lower end of the mixer to the upper part of the mixer.

It comprises, in the lower part thereof, a window 4 communicating with the first channel 3. The opening or window 4 preferably has a rectangular shape, with a height h and a length L (FIG. 2A), defining a surface or section of flow S1 whose dimension is so selected that the first fluid circulating in channel 3 flows in through window 4 in the form of a flat fluid stream. This flat fluid stream reaches section of flow S1 and flows therethrough in a substantially perpendicular direction.

Figure 2A:
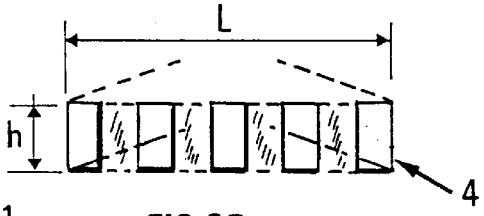
FIGS. 2A and 2B respectively show embodiment variants allowing several flat fluid streams to be obtained.
Figure 2B:
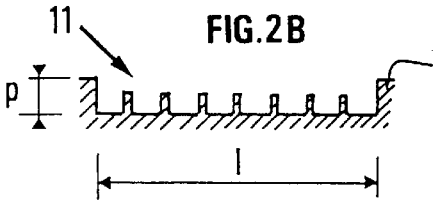

The second part 1*b* also comprises, on the lateral outer wall 5 thereof, a groove 6 or slot, preferably having a helical shape, a depth p and a width l (FIG. 2B). Groove 6 extends for example all along the second part 1*b*. The inside diameter of the outer casing 2 is so selected that the space delimited by groove 6 and the inner wall of the casing, and more particularly the space situated in the neighborhood of window 4, hereafter referred to as mixing area, has small dimensions and preferably substantially equal to the volume defined by the depth and the width of the groove and the surface of the window. The size of the mixing area defined thereby allows to optimize the mixing of the flat fluid streams coming respectively from central channel 3 and from lateral channel 6, as described in the description hereunder.

Advantageously, an area 7 whose shape is so suited that the first fluid leaving channel 3 flows through this area 7 and is distributed with a substantially homogeneous pressure over section of flow S1, as uniformly as possible, is provided in the lower part of the second part 1*b,* between the lower end of circulation channel 3 and opening 4.

The outer casing 2 is provided with at least one inlet port 8*i* for delivering a second fluid to be mixed with the first fluid. The second fluid to be mixed, delivered through port 8*i,* then flows into an annular space 9 formed by the inner wall 10 of outer casing 2 and the outer wall of the first part 1*a*. After leaving this annular space 9, it enters channel 11 formed by groove 6 and the inner wall 10 of casing 2 situated opposite the second part 1*b*. The inner wall 10 preferably has a suitable shape allowing the depth of channel 11 to be substantially constant over the total length thereof and preferably equal to the depth of groove 6. The channel 11 formed thereby has a width and a depth selected to generate a fluid stream having a thin flat shape. The flat stream of the second fluid thus formed, or second flat stream flowing in this channel, acquires a helical motion as it circulates in groove 6. The second fluid stream thus has a direction of flow that is substantially close to the direction of the longitudinal axis of the groove, as described in detail hereafter.

The longitudinal axis of the groove forms an angle $\alpha$ with a perpendicular to the section of flow S1. The value of this angle is so selected that the first fluid stream flowing through section of flow S1 or window 4 and the second fluid stream flowing through the lateral channel meet with an incidence allowing a virtually instantaneous and uniform mixture to be obtained.

At the outlet of window 4, the first fluid stream thus meets the second fluid stream in an area referred to as mixing area 12, delimited for example by the surface of window 4 and the inner wall of casing 2 and which can extend in the neighbourhood of and preferably below this area. The particular flat shape of the two fluid streams, the angle α selected and the limited dimensions of mixing area 12 favor the fast mixing of the two fluids and the homogenization thereof.

The mixture leaves mixing space or area 12 in a helical or spiral form.

Furthermore, the spiral motion of the second flat fluid stream creates a vortex phenomenon carrying the mixture of fluids and possible crystals in the process of formation towards the centre of the spiral thus created. The acceleration due to the vortex and the concentration of this mixture allow to minimize the nucleation phenomena that might lead to phenomena of incrustation on the walls with which the mixture can be in contact. The walls can be those of devices placed after the mixer.

The value of the angle is in the 60°–90° range for example and angle α is preferably substantially equal to 90°.

The dimensions of groove 6, i.e. the depth p and the width l thereof, define, with outer casing 2, the second lateral circulation channel. They are preferably so selected that the width/depth ratio l/p ranges from 10 to 50, for example by selecting a width ranging between 20 and 40 mm and a depth ranging between 1.5 and 0.3 mm. Selection of these dimensions, associated with the layout of the outer casing 2 and of the part 1*b* of the inner piece, allows to generate flat fluid streams, the flat shape allowing the mixing operation to be optimized.

The values of the height h of window 4 and of its length L are preferably so selected that the ratio L/h is at least equal to 10, so as to obtain a first fluid stream of flat shape or first flat stream. They are notably so selected that the first flat fluid stream flows through the section of flow S1 corresponding to the surface of window 4 at a velocity ranging for example between 0.1 and 5 m/sec.

The high velocity values and the small dimensions of the section of flow S1 advantageously allow to benefit by an opening self-cleaning phenomenon. In fact, the possible deposits that may form through contact of the fluids on the walls of the device are detached by the flat fluid streams, the first fluid stream as well as the second, thus creating a sort of phenomenon known as "getting" or "erosion cleaning".

The section of flow S1 of window 4 is for example substantially equal to 1.2 $mm^2$.

Thus, for a first and a second fluid delivered in proportions of 50 $cm^3$/min each, therefore a total flow rate of 100 $cm^3$/min, such dimensions lead to a linear velocity, for each one of the flat fluid streams, of about 0.7 m/sec. The two flat fluid streams enter the confined mixing space where they mix quickly and virtually instantaneously. This procedure improves the homogeneity of the mixture thus formed.

For a section of flow S1 of the order of 0.5 $mm^2$, and for fluids delivered in proportions identical to those mentioned above, the velocity of the flat fluid streams as they enter the mixing area is substantially equal to 5 m/sec.

Window 4 and groove 6 preferably have small dimensions so as to achieve an instantaneous mixture, as uniform as possible, of the two fluids. They are for example made by electro-erosion or by any other technique known to the man skilled in the art, allowing to achieve with precision openings in small-sized pieces with asperity-free edges.

Advantageously, the flat fluid streams to be mixed are subdivided into several elementary flat streams. An embodiment example of the window and of the groove allowing such a result to be obtained is given by way of non limitative example in FIGS. 2A and 2B.

The first flat fluid stream coming from section of flow S1 can be subdivided into several elementary flat streams by positioning for example, just before window 4, a grate-shaped or crenel-shaped element that subdivides the first flat fluid stream into several first elementary flat fluid streams (FIG. 2A).

According to another embodiment variant, groove 6 (FIG. 2B) is preferably suited for generating also several elementary flat fluid streams. It can thus comprise walls allowing several second elementary flat streams to be created.

Subdividing the flat fluid streams and mixing several first elementary flat streams and second elementary flat streams optimizes the mixture of flat fluid streams and the homogeneity thereof.

Area 7, notably designed to allow distribution of the fluid pressure over section of flow S1, preferably has a substantially trapezoidal shape with one side at least corresponding for example to window 4. This shape furthermore allows to obtain a linear velocity, for the first flat fluid stream, that is substantially identical over the whole surface S1.

The number of inlet ports 8*i* can be greater than two so as to obtain a better distribution of the fluid in the lateral channel. These inlet ports can have various shapes, such as circular, triangular shapes, etc, and be uniformly distributed, for example, on the outer casing.

Miscible or immiscible fluids can also be introduced to form the second fluid.

If the fluids to be mixed are fed into the mixer in different proportions, the fluid having the lower flow rate is preferably fed into central channel 3 and the fluid with the higher flow rate is delivered through ports 8*i* in order to flow into the helical channel 11. The helical motion and the great value of the flow of the fluid circulating in the lateral channel allow the latter to carry along the first fluid coming from central channel 3.

The various elements of the mixer are made from steel withstanding pressurized fluids that can be aggressive, or from Hastelloy or Uranus as it is well-known to the man skilled in the art.

The conical part 1*b* of outer casing 2 can be made separately from Teflon, for example, or from a nonpolar material which, owing to its nature, prevents and/or minimizes the formation of incrusting deposits in the mixer.

One of the advantageous applications of the device consists in positioning it at the inlet of a cell intended for the study of the kinetics of formation and evolution of crystals resulting from the bringing together of two incompatible fluids, for example a formation water and one or several injection waters, or a formation water with a product such as a deposition inhibitor, or a formation water with an injection water and a deposition inhibitor.

Figure 3:
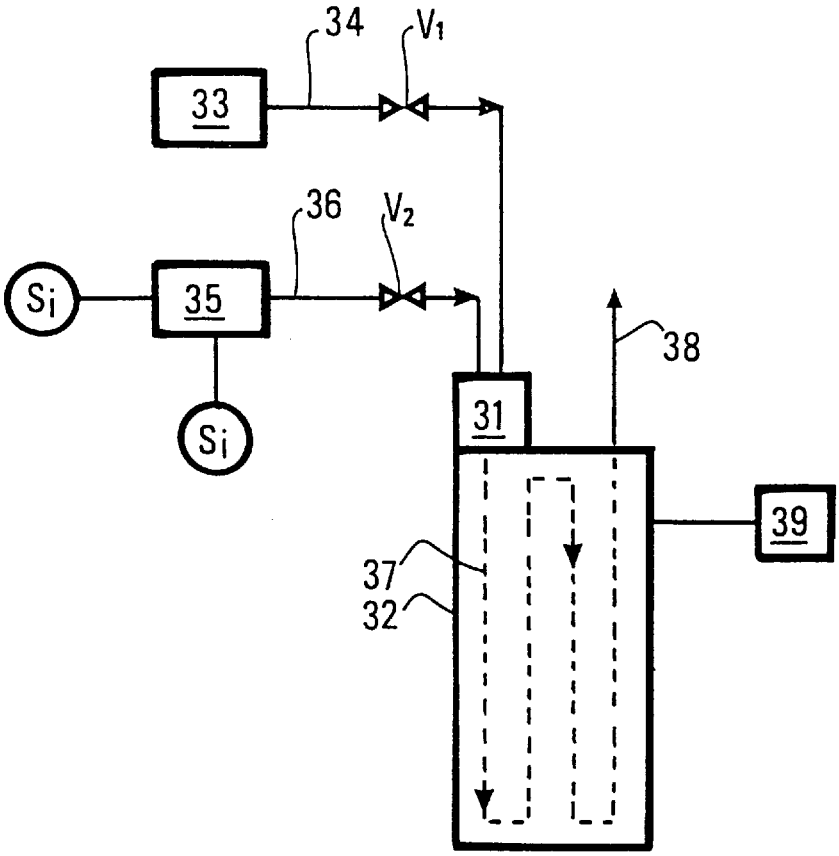
FIG. 3 shows the use of the device associated with a cell for studying and for measuring the deposit formation kinetics, and FIG. 4 diagrammatically shows another variant of the device of FIG. 2 comprising an extension.

FIG. 3 diagrammatically shows a mixer 31 substantially identical to that of FIG. 2, placed at the inlet of a device 32 for studying phenomena of nucleation and germination of crystals resulting from the interaction of a first fluid F1 and of a second fluid F2.

Mixer 31 is for example connected to a first source 33 of fluid F1 by a line 34 communicating with the central channel 3 of the mixer (FIG. 1) and to a second source 35 of fluid F2 by a line 36 connected to at least one of the ports 8*i* (FIG. 1). The second source of fluid can itself be fed by various sources of fluids Si and associated lines Ci. Lines 34 and 36 are advantageously provided with a flow rate regulation and control device such as valves or chokes $V_1$, $V_2$ intended to regulate the quantity of fluids injected.

Mixer 31 is positioned in order to enter the study device 32 and to communicate, in this position, with a circulation pipe 37 allowing passage of the mixture achieved in mixer 31 in study device 32. The mixture flows through circulation pipe 37 and leaves device 32 through a discharge pipe 38.

Device 32 can also be equipped with pressure and temperature control and adjustment means 39 for determining and controlling the thermodynamic parameters linked with the study of the formation of crystals. It can also comprise any other device necessary for the study of the evolution of the mixture in time. These means can be positioned in several places of the device, that will be selected according to the analysis to be carried out.

A working example of such a device consists in feeding the first fluid into channel 3 at a flow rate of 50 $cm^3$/min and in the proportion 50/50, and the second fluid into the helical lateral channel shown in FIG. 2, through a port 8*i*, at a flow rate of the order of 50 $cm^3$/min and in the proportion 50/50.

According to the description given in connection with FIG. 1 and under such conditions, the mixture obtained in the mixing area 12 of mixer 31 leaves the latter in the form of a spiral at a velocity of about 0.7 m/sec and enters pipe 37. Because of the vortex, the mixture of the two fluids is concentrated in the centre of the spiral as mentioned above. This concentration decreases the probability of encounter of the mixture with the wall of circulation pipe 37 and prevents crystal nucleation on the walls before or at the inlet of the study device. The initial time of the study of crystal formation can thus be determined precisely and measurement errors generated by phenomena likely to appear before the device are minimized.

The quickness of the instantaneous or virtually instantaneous mixing contributes to improving the measuring accuracy, notably by delimiting the time when possible reactions start.

Furthermore, the velocity of the mixture at the mixer outlet is at least greater than the velocity it gains as it circulates in pipe 37. The existing velocity difference contributes to preventing the formation of seeds at the level of the walls of circulation pipe 37 and the upward motion of possible seeds at the level of window 4 of the mixer (FIG. 1).

Advantageously, the flow rate and quantity values of each of the fluids delivered at the mixer inlet and set by valves $V_1$, $V_2$ are substantially identical at the mixer outlet.

Such a mixer can be advantageously positioned at the inlet of an inhibitor study device such as that described in patent application EP-033,557.

Figure 4:
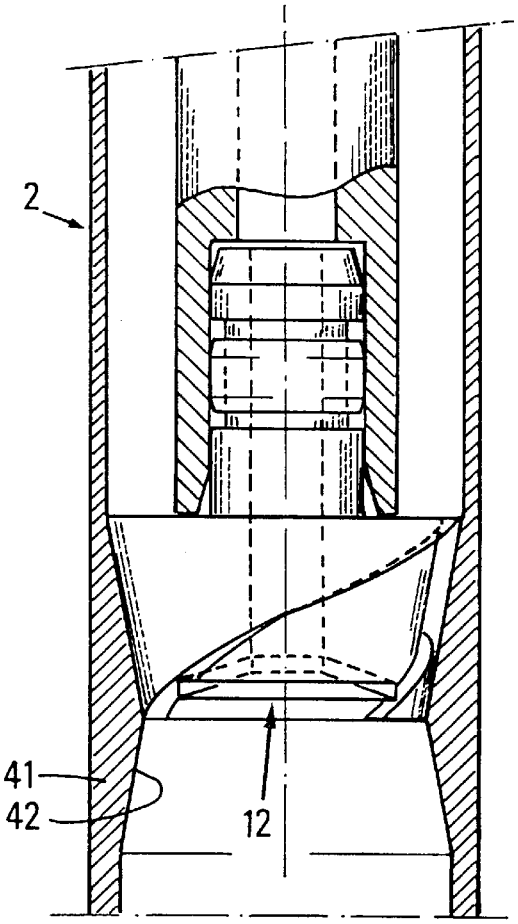

According to a preferred embodiment of the mixer described in FIG. 4, piece 2 comprises an extension 41. It is positioned, for example, after mixing area 12 (FIG. 1), at the level of the lower end of the mixer. The shape of the inner wall 42 of extension 41 is suited to maintain the helical motion of the mixture at the mixer outlet, notably the vortex effect allowing to concentrate the mixture of fluids in the centre of the spiral or helicoid in order to minimize the probability of contact of the reacting mixture on the walls of pipe 37 (FIG. 3) with which it communicates as described above. This shape opens out from the lower end of the mixer. The term "reacting mixture" relates to a mixture of fluids that may cause corrosive and/or incrusting actions.

An interesting application of the invention consists in mixing at least one inhibitor from a source Si with a fluid serving as a carrier vector and coming from another source Si. The term carrier vector means that the carrier fluid which the inhibitor is mixed with does not interact on it. The inhibitor must only act with the first fluid from the first source, that is injected for example through the central channel of the mixer. Such a procedure allows to optimize the mixing of the fluids so that the action of the inhibitor starts in the kinetics study device and not outside the study device. The time of the formation of the mixture is thus precisely known, and this mixing time corresponds notably to the time when the inhibitor starts to act. The measuring accuracy is thus increased since the inhibitor acts on the mixture only when the latter is in device 32.

Within the scope of petroleum production for example, the use of such a mixer allows an inhibitor to be introduced when organic, inorganic or hydrate crystals start to form for example.

Without departing from the scope of the invention, it is also possible to use this type of device within the scope of waste household and industrial water treatment, for example in the particular field of geothermics.

The device is advantageously used to produce an emulsion in determined proportions, notably an emulsion made from immiscible fluids. In fact, the mixing operation in the mixer occurring virtually instantaneously and at high velocities "creates" the emulsion. It is thus possible to achieve readily a water-in-oil emulsion or an oil-in-water emulsion.

I claim:

1. A device for mixing at least a first and a second incompatible fluid, comprising an inner piece including at least a first feed channel for delivering said first fluid, said first channel communicating with a window situated in the lower part of inner piece, said window having an elongate cross-sectional shape S1 through which the first fluid can flow, said cross-sectional shape S1 being so selected that the first fluid flows out of said window in the form of a first fluid stream having a flat cross-sectional shape, said inner piece also comprises a groove situated on an outer wall thereof, said groove having a depth p and a length lg, an outer casing surrounding said inner piece, said outer casing being provided with at least one inlet port for delivering the second fluid and said outer casing being so positioned with respect to inner piece that an inner wall of the outer casing delimits, with groove, a lateral circulation channel generating a second fluid stream having a flat cross-sectional shape, the first and second fluid streams meeting in a mixing area delimited by the window, the circulation channel and the inner wall of the outer casing so as to form a virtually instantaneous and uniform mixture.

2. A device as claimed in claim 1, wherein the window and the lateral circulation channel are arranged with respect to each other such that the direction of flow of the first fluid stream forms an angle $\alpha$ with the direction of flow of the second fluid stream, ranging between 60° and 90°.

3. A device as claimed in claim 1, wherein the cross-sectional shape S1 is defined by a length L and a height h, and the ratio L/h is at least above 10.

4. A device as claimed in claim 1, wherein the cross-sectional shapes of the window and the lateral circulation channel are such that the flat streams of said first fluid and second fluid have velocities ranging between 0.1 and 5 m/sec.

5. A device as claimed in claim 1, wherein said first channel is situated substantially in the center of inner piece, and inner piece comprises, at the level of a lower end thereof, an area situated between the lower end of central channel and window, the shape of area being so selected that the pressure of the flat stream of the first fluid is distributed substantially uniformly over the cross-sectional shape S1 of the window and the velocity thereof is substantially uniform over the cross-sectional shape S1 of the window.

6. A device as claimed in claim 5, wherein said first channel and said window are arranged with respect to one another such that the direction of flow of said first fluid stream is substantially perpendicular to a direction of flow of said first fluid through said first channel.

7. A device as claimed in claim 1, wherein lateral circulation channel has a helical shape so as to communicate a helical motion to the second fluid.

8. A device as claimed in claim 7, wherein said first channel and said window are arranged with respect to one another such that the direction of flow of said first fluid stream is substantially perpendicular to a direction of flow of said first fluid through said first channel.

9. A device as claimed in claim 7, wherein an upper part of said inner piece has a substantially cylindrical outer wall, a lower part of said inner piece has a truncated cone shape, and said groove is provided on the outer wall of said lower part of said inner piece.

10. A device as claimed in claim 1, wherein said outer casing comprises an extension of suitable shape for maintaining the helical motion of the mixture of fluids at the outlet of mixing area.

11. A combination of the device as claimed in claim 1 and a cell for studying the deposit formation kinetics of a mixture of two incompatible fluids, wherein the device is positioned at the inlet of the cell for studying the deposit formation kinetics of a mixture of two incompatible fluids.

12. A device as claimed in claim 1, wherein the window and the lateral circulation channel are arranged with respect to each other such that the direction of flow of the first fluid stream forms an angle $\alpha$ with the direction of flow of the second fluid stream, of substantially 90°.

13. A device as claimed in claim 1, wherein lateral circulation channel has a spiral shape so as to communicate a spiral motion to the second fluid.

14. A device as claimed in claim 13, wherein said outer casing comprises an extension of suitable shape for maintaining the spiral motion of the mixture of fluids at the outlet of mixing area.

15. A device as claimed in claim 13, wherein said first channel and said window are arranged with respect to one another such that the direction of flow of said first fluid stream is substantially perpendicular to a direction of flow of said first fluid through said first channel.

16. A device as claimed in claim 13, wherein an upper part of said inner piece has a substantially cylindrical outer wall, a lower part of said inner piece has a truncated cone shape, and said groove is provided on the outer wall of said lower part of said inner piece.

17. A device as claimed in claim 1, wherein said window has first and second opposed major surfaces parallel to one another over at least a portion of their length.

18. A device as claimed in claim 17, wherein said window has a rectangular cross-sectional shape.

19. A device as claimed in claim 1, wherein said first channel and said window are arranged with respect to one another such that the direction of flow of said first fluid stream is substantially perpendicular to a direction of flow of said first fluid through said first channel.

20. A method of using the device as claimed in claim 1 for generating an emulsion from immiscible fluids, comprising delivering the first fluid through said first channel and through said window, delivering the second fluid through said inlet port, and through said lateral circulation channel, and mixing said first and second fluids in said mixing area to form said emulsion.

* * * * *